US005548381A

United States Patent [19]

Saito et al.

[11] Patent Number: 5,548,381

[45] Date of Patent: Aug. 20, 1996

[54] DEVELOPING APPARATUS FORMING ALTERNATING ELECTRIC FIELD BETWEEN IMAGE BEARING MEMBER AND TONER CARRYING MEMBER

[75] Inventors: Yoshiro Saito; Haruo Fujii; Hiroshi Sasame, all of Yokohama; Tatsuhiko Hayakawa, Tokyo; Tatsuya Kobayashi, Sohka; Tetsuya Kobayashi, Kawasaki; Naoki Enomoto, Yokohama; Akihiko Uchiyama, Yokohama; Youichirou Maebashi, Yokohama, all of Japan

[73] Assignee: Canon Kabushiki Kaisha, Tokyo, Japan

[21] Appl. No.: 305,557

[22] Filed: Sep. 14, 1994

[30] Foreign Application Priority Data

Sep. 14, 1993 [JP] Japan ..... 5-250974
Sep. 13, 1994 [JP] Japan ..... 6-243463

[51] Int. Cl.[6] ..... G03G 15/06

[52] U.S. Cl. ..... 355/245; 355/208; 355/215

[58] Field of Search ..... 355/208, 210, 355/215, 219, 245, 246, 259, 261, 264, 265, 270, 296; 118/653

[56] References Cited

U.S. PATENT DOCUMENTS

| | | | |
|---|---|---|---|
| 4,766,468 | 8/1988 | Hosono et al. . | |
| 4,789,878 | 12/1988 | Endo et al. . | |
| 4,814,834 | 3/1989 | Endo et al. . | |
| 4,887,102 | 12/1989 | Yoshikawa et al. . | |
| 5,032,852 | 7/1991 | Fuji et al. . | |
| 5,066,979 | 11/1991 | Goto et al. | 355/208 |
| 5,142,332 | 8/1992 | Osawa et al. | 355/208 |
| 5,175,584 | 12/1992 | Usui | 355/208 |
| 5,183,964 | 2/1993 | Stelter et al. | 355/259 X |
| 5,187,523 | 2/1993 | Osawa | 355/259 X |
| 5,198,861 | 3/1993 | Hasegawa et al. | 355/246 |
| 5,287,149 | 2/1994 | Hoshika | 355/246 |
| 5,307,127 | 4/1994 | Kobayashi et al. | 355/259 |
| 5,404,213 | 4/1995 | Okano et al. | 355/265 |

*Primary Examiner*—Sandra L. Brase
*Attorney, Agent, or Firm*—Fitzpatrick, Cella, Harper & Scinto

[57] ABSTRACT

A developing apparatus includes a toner carrying member, disposed opposite an image bearing member for bearing an electrostatic image, for carrying toner to the image bearing member; an electric field forming device for forming an alternating electric field between the image bearing member and the toner carrying member, wherein the alternating electric field includes a first phase in which a constant electric field for urging the toner from said image bearing member toward said toner carrying member continues for a predetermined period, a second phase in which a constant electric field for urging the toner from said toner carrying member toward said image bearing member continues for a predetermined period, and a third phase in which the electric field gradually changes from that in the first phase to that in the second phase within a predetermined period ΔT; and a controller for changing a ratio (ΔT/T), where T is one period of the alternating electric field.

6 Claims, 17 Drawing Sheets

| IMAGE QUALITY \ AREA | | | | |
|---|---|---|---|---|
| EDGE | — | N | G | G |
| DENSITY | N | G | G | N |

G = GOOD
N = NO GOOD
— = NON-DISCRIMINATABLE

DEVELOPING APPARATUS FORMING ALTERNATING ELECTRIC FIELD BETWEEN IMAGE BEARING MEMBER AND TONER CARRYING MEMBER

FIELD OF THE INVENTION AND RELATED ART

The present invention relates to a developing apparatus for developing an electrostatic latent image on an image bearing member, usable with an image forming apparatus such as an electrophotographic apparatus or electrostatic recording apparatus.

In a widely used image forming apparatus such as an electrophotographic apparatus or an electrostatic recording apparatus, an electrostatic image on an image bearing member is developed by a developing device containing toner.

Referring first to FIG. 10, there is shown an example of such an apparatus. In FIG. 10, reference numerals 1, 5, 4 and 12 designate a photosensitive drum, a charger for uniformly charging the photosensitive drum, light emitting elements for projecting light to the photosensitive drum having been charged, and a developing device for effecting reverse-development to deposit toner on portions of the photosensitive drum exposed to the light, respectively.

The developing device 12 comprises a toner container 6 for containing non-magnetic toner, a developing sleeve 2 for carrying the toner, an application roller 3 for applying the toner onto the developing sleeve, and a blade 7 for regulating a toner layer thickness on the developing sleeve.

The developing sleeve 2 is supplied with a bias voltage from a bias voltage source 8. The bias voltage may be of a sine wave as shown in FIG. 11, a triangular wave as shown in FIG. 12, a saw teeth wave as shown in FIG. 13, a rectangular wave as shown in FIG. 14 or a pulse bias as shown in FIG. 15, wherein a time period in which a peak level (Vmax) for forming an electric field for urging the toner from the developing sleeve toward the photosensitive drum is applied, and a time period in which a peak level (Vmin) for forming an electric field for urging the toner from the photosensitive drum 1 toward the developing sleeve 2, are different, and one or more pairs of Vmax and Vmin are combined into pulses. These bias voltages are known.

The charged toner on the developing sleeve is transferred from the surface of the developing sleeve 2 onto the surface of the photosensitive drum 1 by the force of the electric field, so that an electrostatic latent image is developed.

With the recent development of computer graphics techniques, images of an electrophotographic or electrostatic recording apparatus, are desired to be of higher image quality.

However, the image density is not sufficient when the developing bias is in the form of a sine wave, a rectangular wave, or a saw teeth wave.

In order to increase the image density, it will suffice if a larger amount of the toner is transferred from the sleeve to the photosensitive drum. To accomplish this, there are known a method in which the peripheral speed of the sleeve relative to the photosensitive drum is increased, or a method in which the Vmax is increased to increase the development efficiency, or a method in which the DC component is changed.

However, if the sleeve peripheral speed is too high, the temperature of the sleeve increases and results in fusing of the toner on the bearing, fog being produced or toner being scattered in the apparatus. If the Vmax is increased, or if the DC component is changed, then there is a possibility of spark discharge between the photosensitive drum and the developing sleeve (SD gap), and additionally the possibility of foggy background production. The spark discharge may damage the photosensitive drum or the developing sleeve, and fuse the toner on the developing sleeve, resulting in the necessity for the exchange of parts.

In view of the above, a rectangular wave is preferable for the developing bias voltage.

When the force for transferring the toner toward the photosensitive member (toner transition force) by the developing bias is too strong, an edge effect is increased, and therefore, a pulse bias having a longer Vmin than Vmax is preferable among various rectangular waves.

In the pulse bias type, the level of Vmax is fixed, and only the time period of Vmax is increased, or the number of pulses is increased, by which the image density is increased without spark discharge.

When an electrostatic latent image of 5 mm×5 mm is developed using a pulse bias, the image density can be increased without increasing the edge effect. However, as shown in FIG. 16, the density at a trailing or downstreaming portion g of the 5 mm×5 mm square is remarkably higher than at the other portion G (downstream concentration), so that a uniform toner image is not produced. This has been found as a problem.

As for the developing bias voltage applied between the photosensitive drum and the developing sleeve, as shown in FIG. 17, when the bias voltage (developing bias voltage) applied across the gap between the photosensitive drum and the developing sleeve has a period C (falling) between a period A (Vmin) in which a back transition electric field (the electric field for urging the toner from the photosensitive drum toward the developing sleeve) is formed and a period B (Vmax) in which a transition electric field (the electric field for urging the toner from the developing sleeve toward the photosensitive drum) is formed, high quality toner images can be provided without the downstream concentration or insufficient image density.

If the falling period (period C) is long, the downstream concentration is effectively prevented, but the longer period is not advantageous for the image density.

Accordingly, when the ambient condition changes, proper developed images are not provided.

SUMMARY OF THE INVENTION

Accordingly, it is a principal object of the present invention to provide a developing apparatus without downstream concentration and with sufficient image density.

It is another object of the present invention to provide a developing apparatus capable of providing stabilized developed images irrespective of ambient conditions.

According to an aspect of the present invention, there is provided a developing apparatus comprising: a toner carrying member, opposed to an image bearing member for bearing an electrostatic image, for carrying toner; electric field forming means for forming an alternating electric field between said image bearing member and said toner carrying member, wherein the alternating electric field including a first phase in which a constant electric field for urging the toner from said image bearing member toward said toner carrying member continues for a predetermined period, a second phase in which a constant electric field for urging the toner from said toner carrying member toward said image bearing member continues for a predetermined period, and a third phase in which the electric field gradually changes from that in the first phase to that in the second phase within a predetermined period; and means for changing a ratio ($\Delta T/T$) of the predetermined period $\Delta T$ for change from the first phase to the second phase of one period T of the alternating electric field.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The description will be first made as to the prevention of downstream concentration, provided by the falling regulated bias voltage, on the basis of experiments carried out by the inventors.

Figure 18:
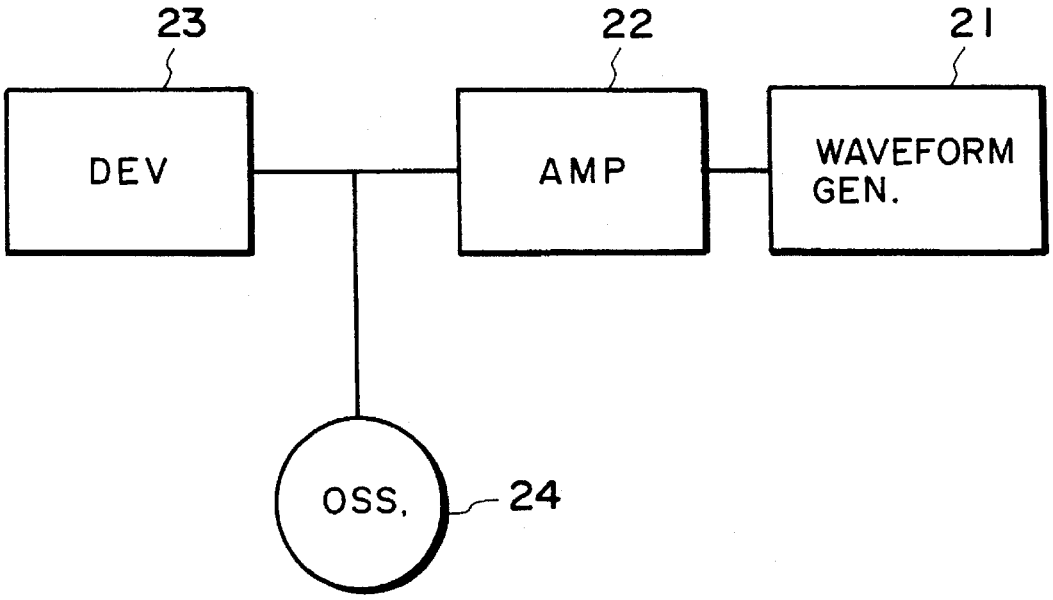
FIG. 18 is a block diagram of an apparatus used in an experiments.

Referring first to FIG. 18, there is shown an experimental apparatus, in which a waveform generator 21 is connected to a developing apparatus 23 through an amplifier 22, and an oscilloscope 24 is connected between the amplifier 22 and the developing apparatus 23. While the waveform of the developing bias generated by the waveform generator 21 is being monitored, the developing bias voltage is applied to the developing apparatus 23 to effect the developing action.

Figure 10:
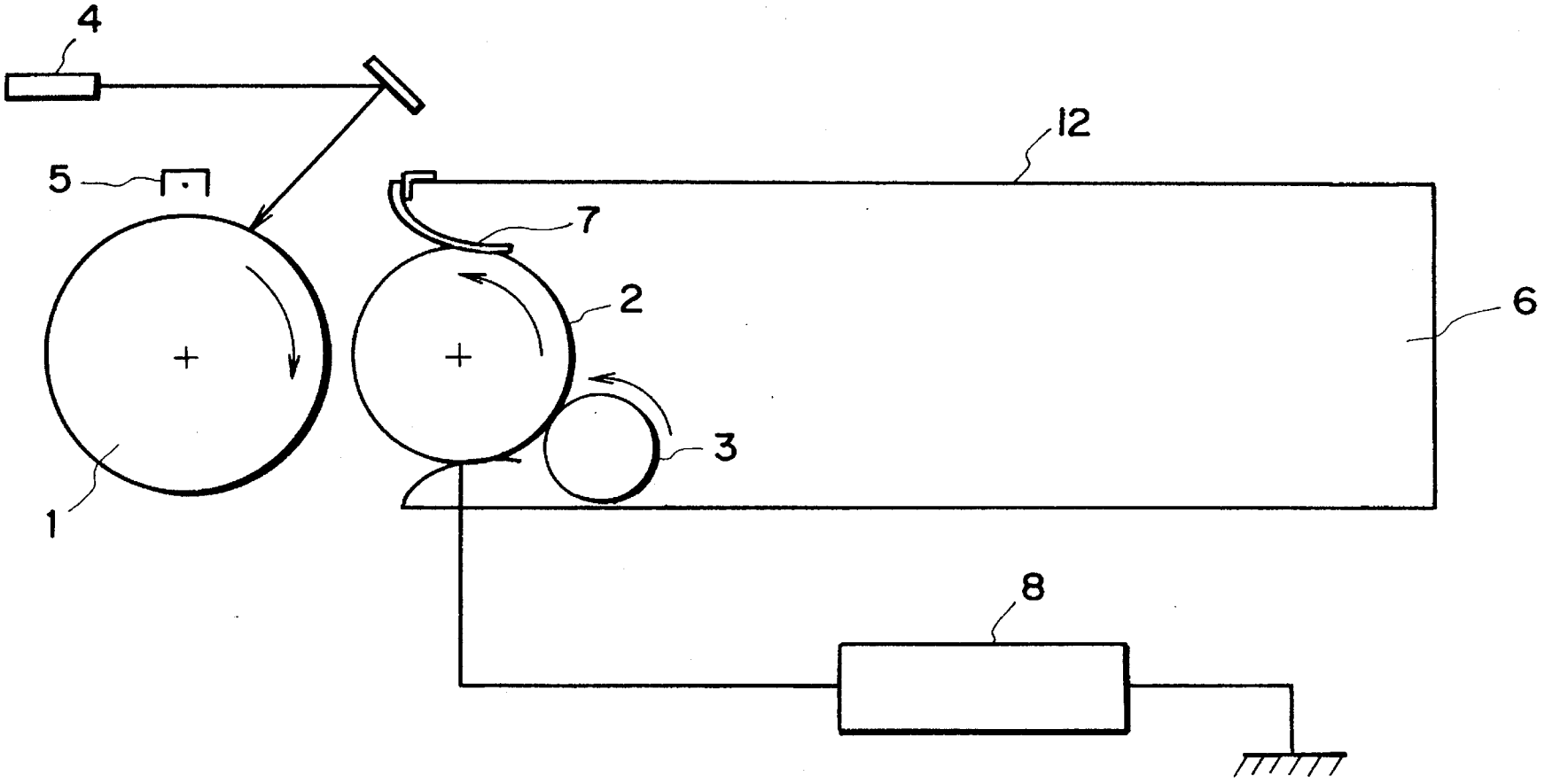
FIG. 10 is a schematic view of a developing apparatus.
Figure 11:
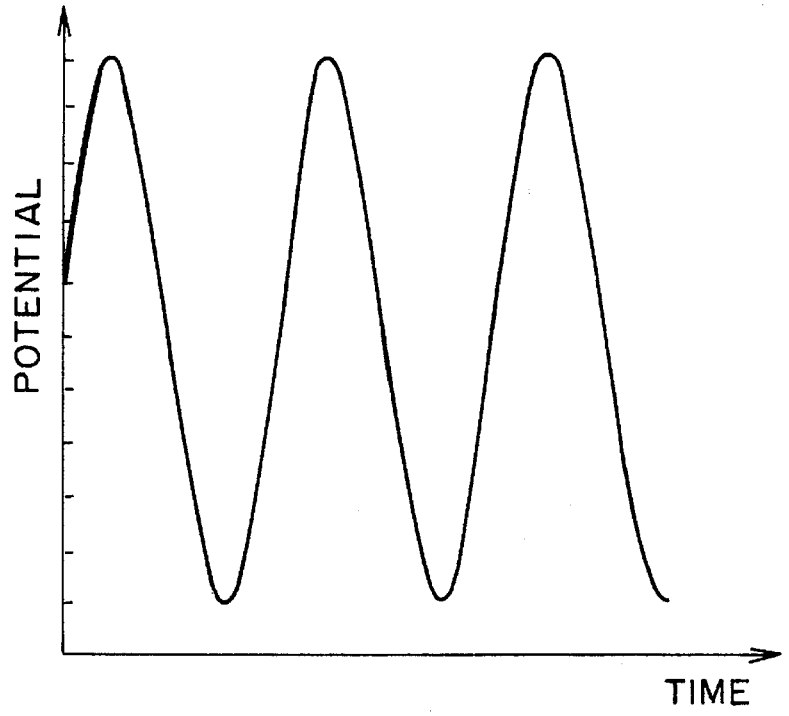
FIG. 11 shows a waveform of a developing bias voltage used in the developing apparatus of FIG. 10.
Figure 12:
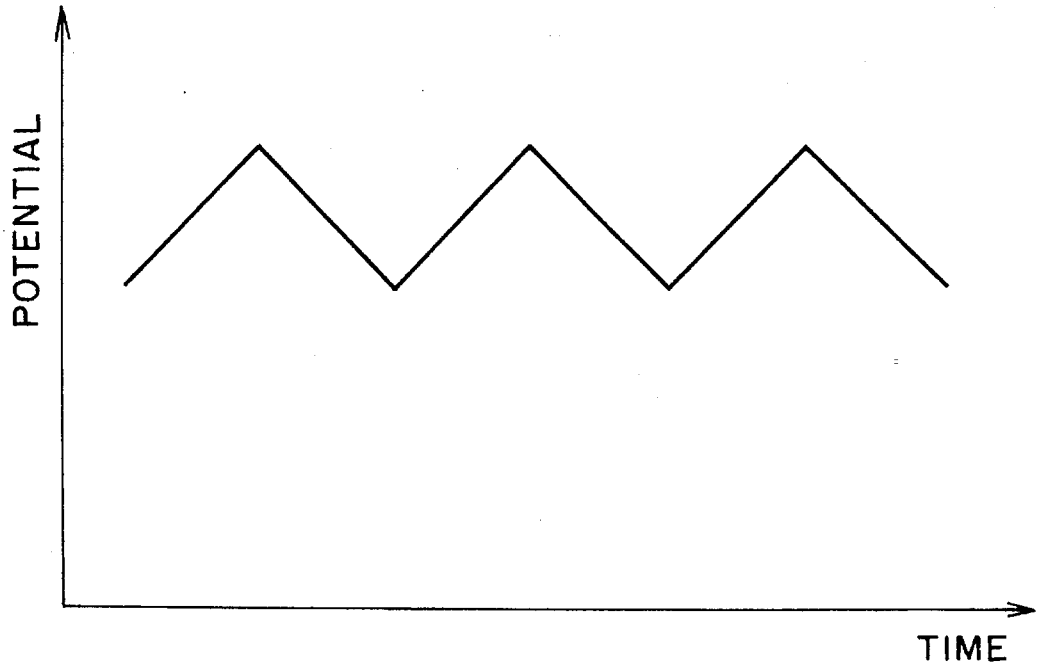
FIG. 12 shows a waveform of another example of the developing bias voltage.
Figure 13:
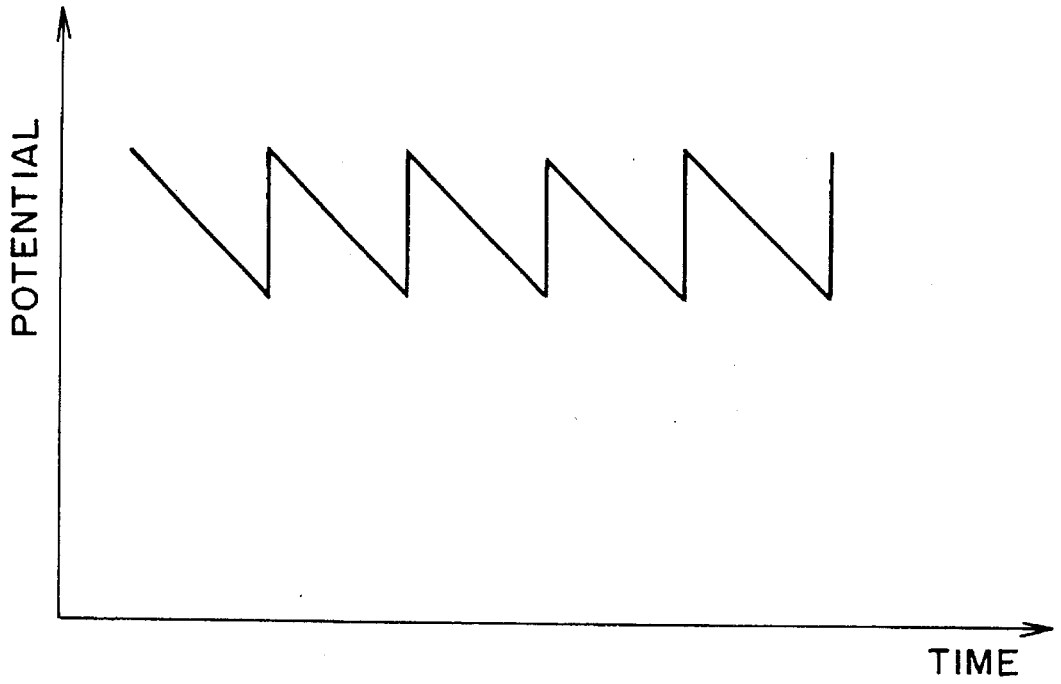
FIG. 13 shows a waveform of a further example of the developing bias voltage.
Figure 14:
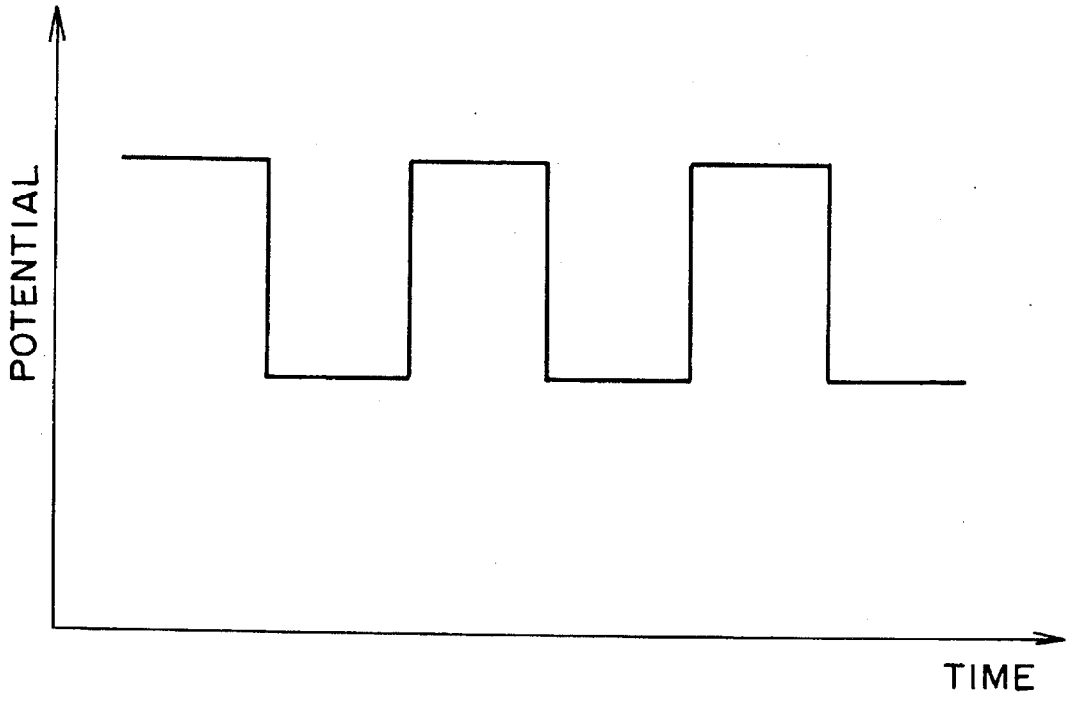
FIG. 14 shows a waveform of a further example of the developing bias voltage.
Figure 15:
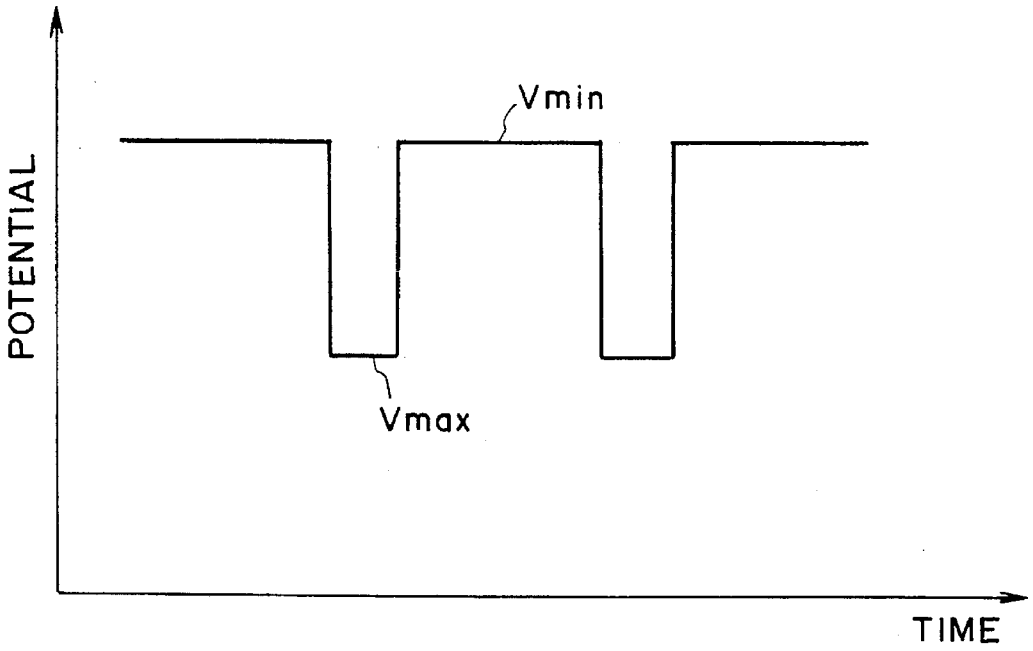
FIG. 15 shows a waveform of a further example of the developing bias voltage.
Figure 16:
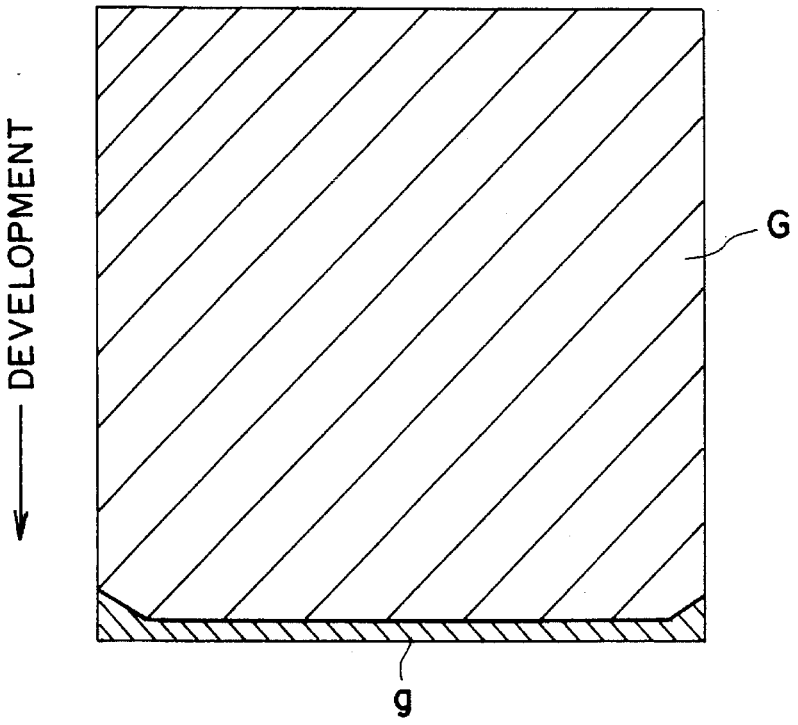
FIG. 16 illustrates the occurrence of a downstream concentration in the toner image provided when the developing bias voltage of FIG. 12 or the like is applied.
Figure 17:
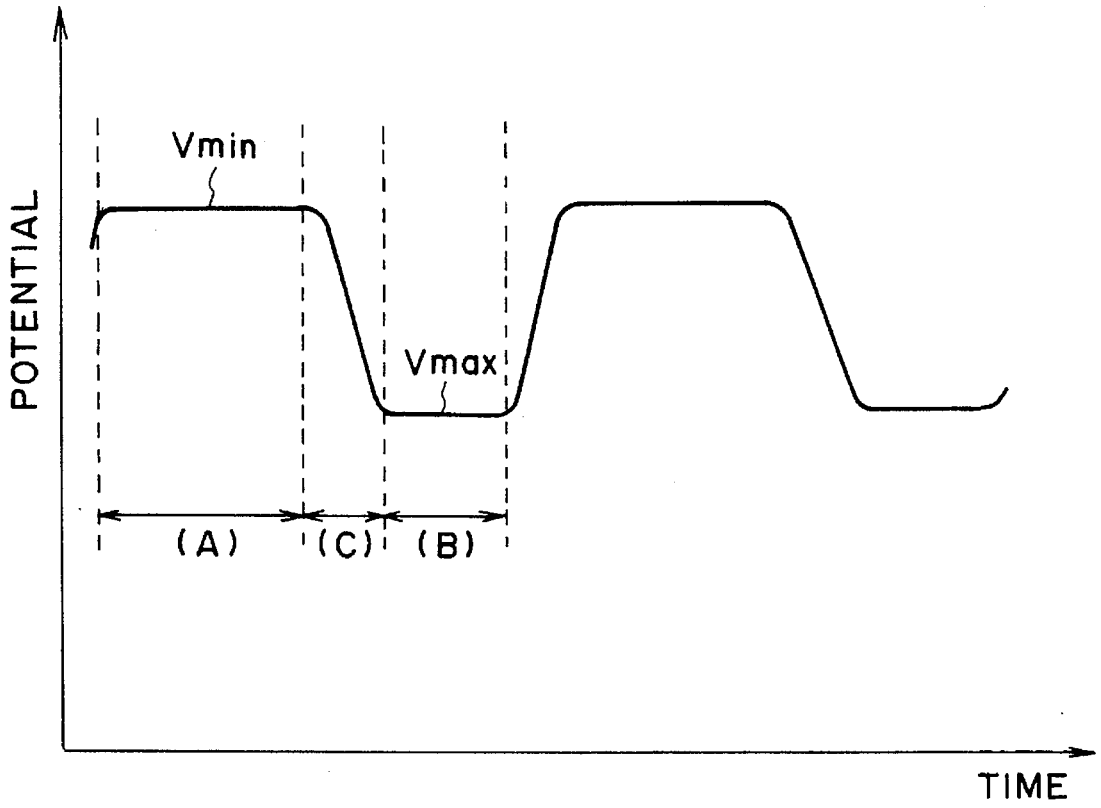
FIG. 17 shows a waveform of a regular falling bias voltage used as a developing bias voltage according to an embodiment of the present invention.

The developing apparatus 23 is the same as shown in FIG. 10, in the cross-sectional view.

The photosensitive drum 1 has a diameter of 30 mm and is rotated at a peripheral speed of 60 mm/sec in the indicated direction. It is uniformly charged by a primary charger 5 disposed adjacent thereto to −600 V. Subsequently, the photosensitive drum 1 is exposed to image information light provided by light emitting means 4 such as a laser or LED or the like. By this exposure, the potential of the exposed portion changes to −100 V, so that an electrostatic latent image having an image portion (exposed portion) is formed to receive the toner.

In the developing apparatus 23, the non-magnetic toner in the toner container 6 containing non-magnetic toner as the developer, is applied on the surface of the developing sleeve 2 having a diameter of 16 mm and rotating in the indicated direction, by an application roller 3 having a diameter of 8 mm and rotating in the indicated direction. The layer of the toner applied on the surface of the developing sleeve 2 is maintained at a constant thickness by the elastic blade 7 of urethane rubber or the like. The toner particles are rubbed by the blade 7, the application roller 3 and the developing sleeve 2 so as to be charged to 6.0 μC/g–30.0 μC/g.

The photosensitive drum and the developing sleeve are disposed out of contact from each other with a gap of 50–500 μm. In this embodiment, the gap 300 mm.

The description will be made as to the developing bias voltage applied to the developing sleeve (toner carrying member) to form an alternating electric field between the image bearing member and the toner carrying member.

Figure 19:
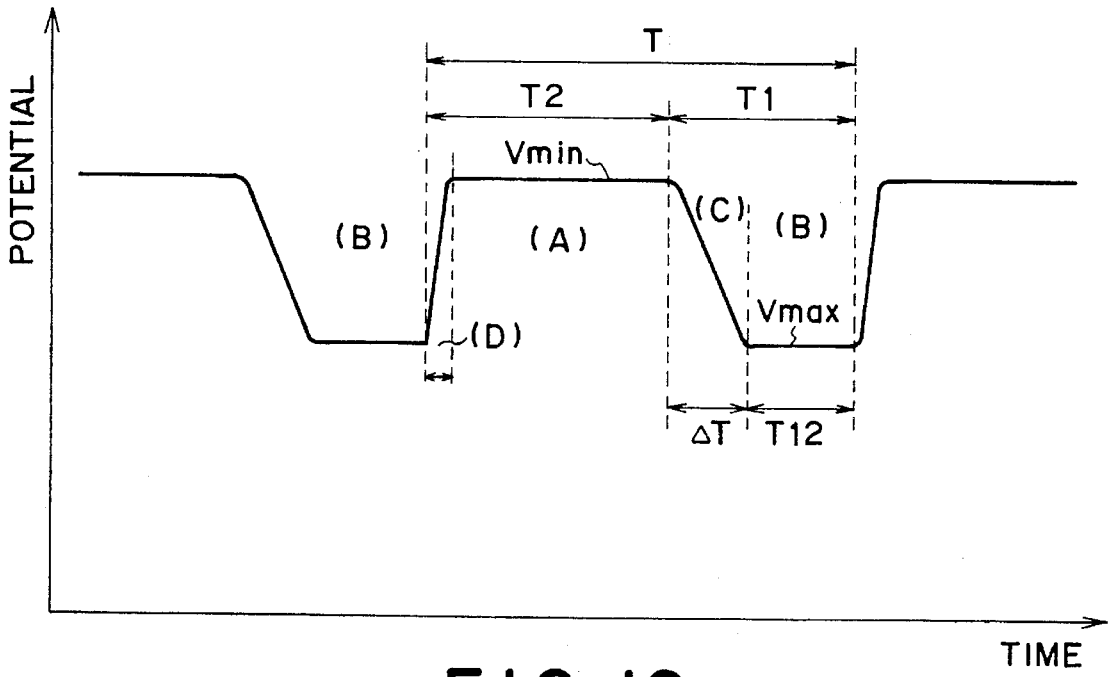
FIG. 19 shows a waveform in one period of an AC component of the developing bias voltage used in the embodiments of FIG. 18, wherein various elementary steps are shown.

Referring now to FIG. 19, it is assumed that one period of the developing bias voltage is T; that is the time period T1 is a sum of the period of Vmin and the time period (rising period) in which the level changes from Vmax to Vmin; and the other time period is T1. It is also assumed that the time period of Vmax is T12, and the falling period is ΔT. A duty percentage is defined as (T1/(T2+T1))×100, and an inclination percentage is defined as (ΔT/T)×100=ΔT/(T1+T2)×100.

Figure 20:
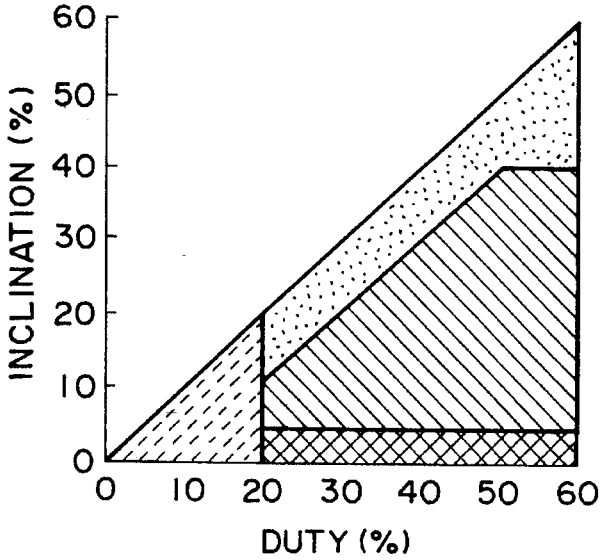
FIG. 20 illustrates a relationship between an inclination percentage and duty percentage in one period of an AC component of the developing bias voltage and the occurrence of a downstream concentration and insufficient image density of a 5 mm×5 mm square image.

FIG. 20 shows results of experiments by the inventors about the relationships among the period T1, the percentage of ΔT, the downstream concentration of toner in a 5 mm square image, and the image density. The duty percent is changed from 0% to 60.0 %, and the inclination percentage is changed from 0% to the maximum for the respective duty percentages. When the duty percentage is not higher than 20%, the transition component is too small with the result of insufficient image density. When the duty percentage is not less than 20%, the downstream edge concentration occurs if the inclination percentage is not more than 5% and if the inclination percentage is too high, the bias voltage waveform is so close to a triangular wave that the insufficient image density occurs. In the range in which the duty percent can provide sufficient density and in which the inclination of the duty percent is not such that the bias voltage waveform is not close to a triangular wave, satisfactory images without downstream concentration and density insufficiency are provided, when the inclination percentage is 5%–40%.

The reason for this is considered as follows, although the reasons are not clear. First, a mechanism of the downstream (edge) concentration of the toner will be considered.

Figure 21:
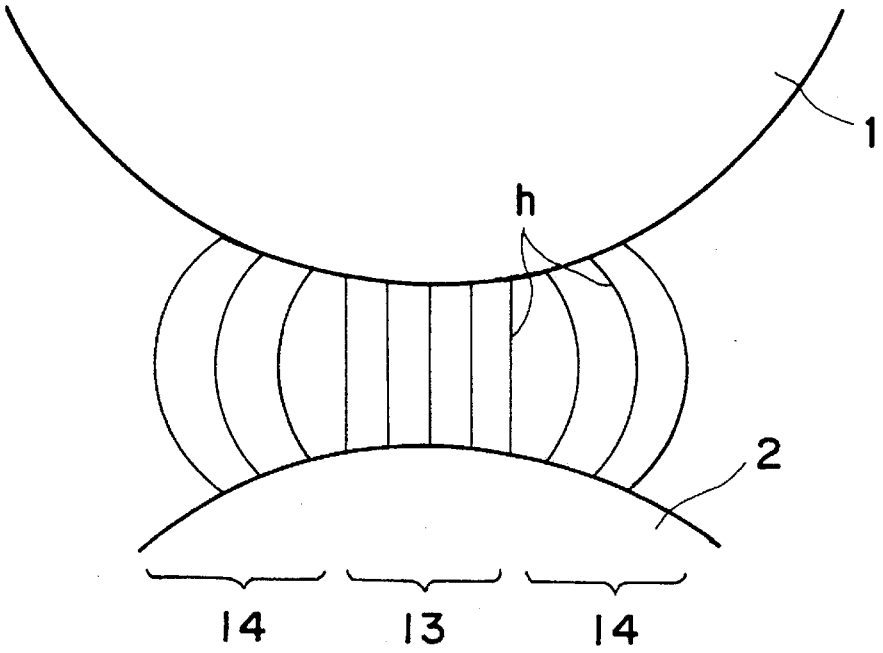
FIG. 21 is a sectional view of electric lines of force in the SD gap between the photosensitive drum and the developing sleeve supplied with a developing bias voltage.
Figure 22:
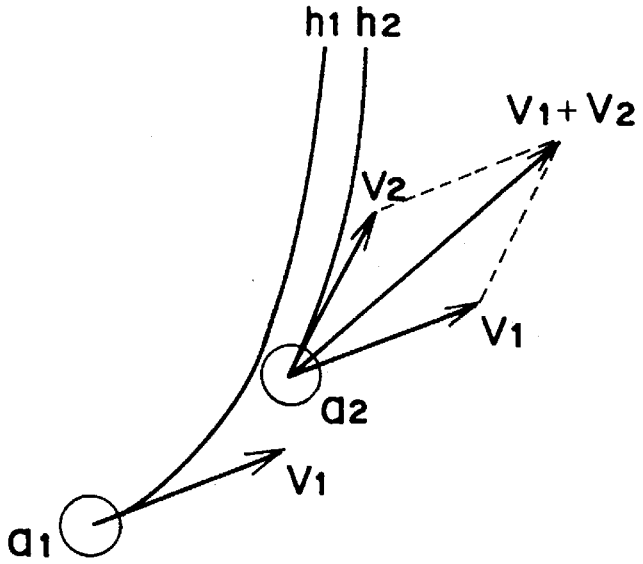
FIG. 22 schematically illustrates a movement direction of the toner due to the electric field force at a lateral end between the SD gap supplied with a developing bias voltage when the surface of the photosensitive drum faced to the developing sleeve has an image.
Figure 23:
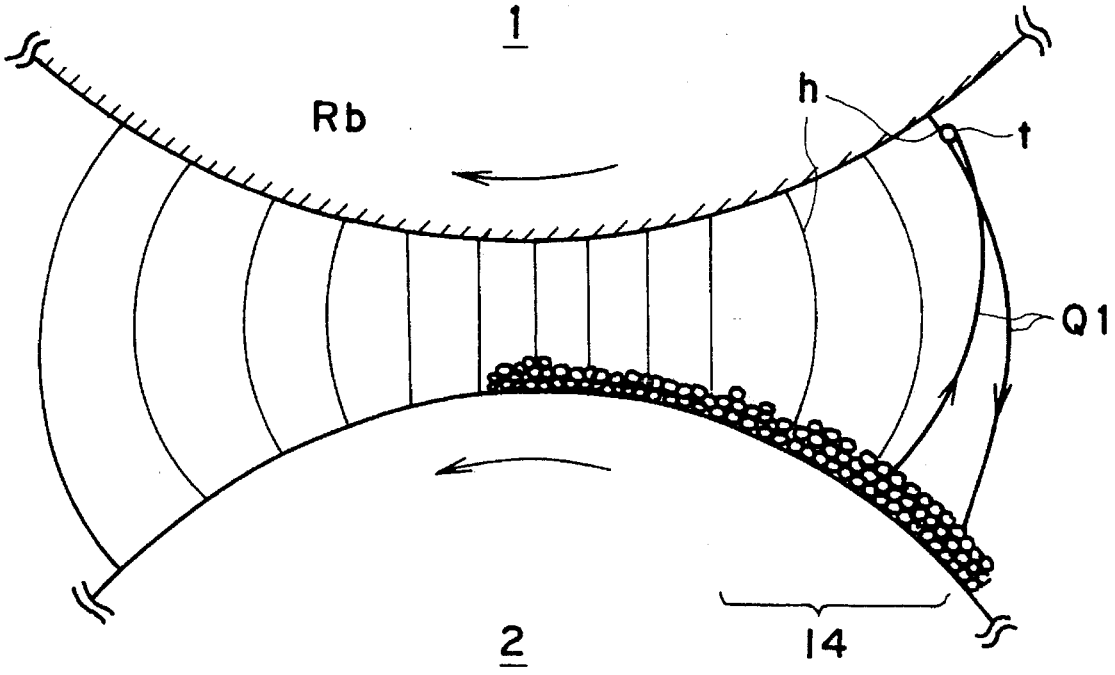
FIG. 23 is a sectional view illustrating a part of a mechanism resulting in the occurrence of a downstream toner concentration due to the behavior of the toner in the SD gap supplied with the developing bias voltage.

FIG. 21 is a sectional view of the SD gap supplied with a developing bias voltage, and the electric lines of force h are shown between the photosensitive drum and the developing sleeve. At the central portion 13 between the photosensitive drum 1 and the developing sleeve 2, the electric lines of force are substantially rectilinear, but are curved at the end portions 14. FIG. 22 illustrates the movements of toner particles due to the electric field in the SD gap, schematically, at the end portions 14 when the image portion of the photosensitive drum 1 is faced to the photosensitive drum 2. The toner has a velocity V1 in the direction of a tangent line of the electric line of force at point al on the electric line hl of the force which is curved. At the next instance, when the toner comes to point a2, the toner has a velocity V2 along tile tangent line of the electric line of force at point a2. Then, the toner moves from point a2 in a direction of a combination of the velocities VI+V2. As shown in FIG. 23, at the end portion 14, the toner does not move along the electric lines of force, but reciprocates with gradual deviation toward the outside between the photosensitive drum and the developing sleeve, as indicated by an arrow Q1 in FIG. 23.

Figure 24:
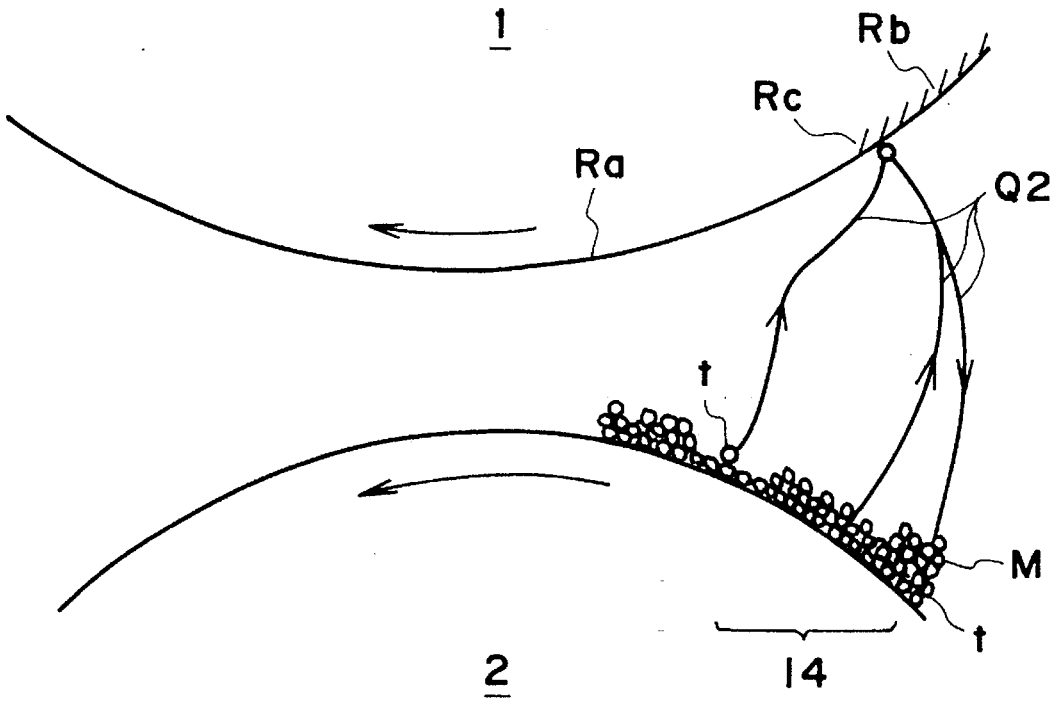
FIG. 24 is a sectional view illustrating a part of the mechanism.

As shown in FIG. 24, when an image leading edge Rc which is a boundary between the non-image portion Ra (the photosensitive drum surface potential of −600 V) and an image portion Rb (the surface potential of −100 V), comes to the end 14 of the SD gap where the electric lines of electric force are curved, the toner t at downstream of the image portion Rb with respect to the rotational direction of the sleeve 2, moves toward the image side, as indicated by an arrow Q2 in FIG. 24. In this manner, toner particles t are concentrated at the leading edge Rc of the image, and the concentrated toner particles return to the opposite side (upstream side) with respect to the rotational direction of the sleeve, with the result of a large toner stagnation M at point A.

Figure 25:
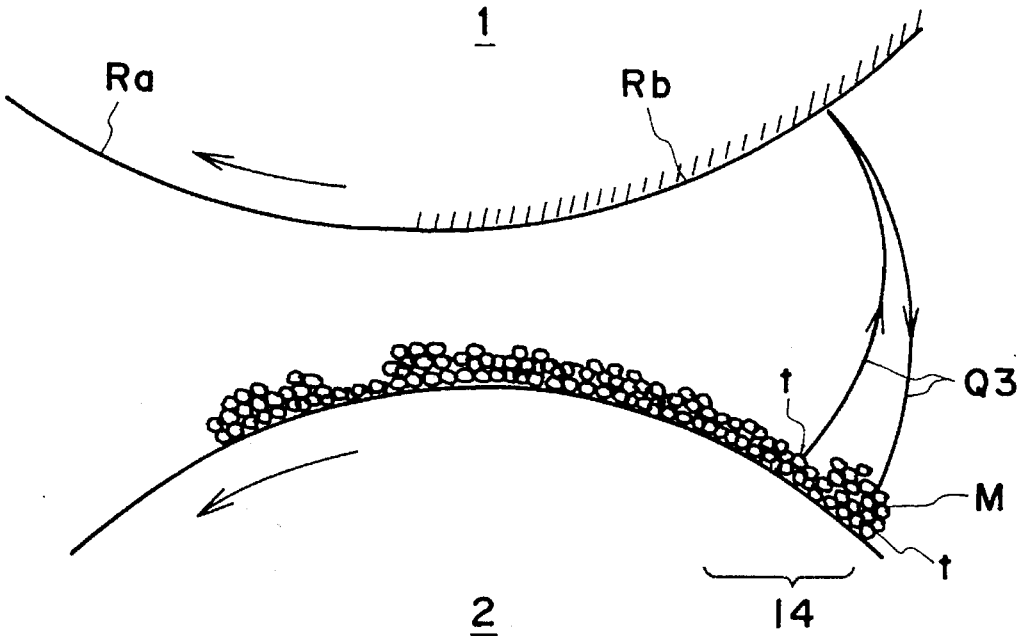
FIG. 25 is a sectional view illustrating a part of the mechanism.

Subsequently, as shown in FIG. 25, when the image portion Rb comes to the end 14, the toner t moves along the arrow Q3 with the result of a larger amount of toner accumulated at M. In this manner, irrespective of the rotation of the developing sleeve 2, the toner continues to stagnate at M which is an upstream fixed position of the developing sleeve 2, and the amount of the stagnated toner T increases.

Figure 26:
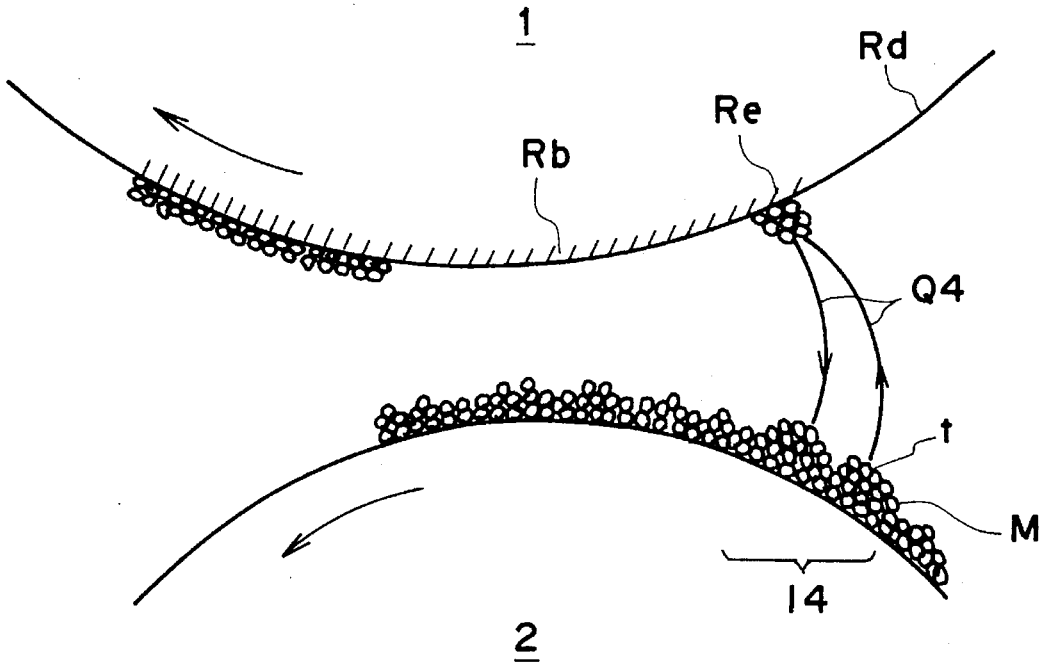
FIG. 26 is a sectional view illustrating a part of the mechanism.

As shown in FIG. 26, by rotation of the photosensitive drum 1, the trailing edge Re which is the boundary between the image portion Rb and the non-image portion Rd of the photosensitive drum 1, comes to the end 14, and the electric field is concentrated to the trailing edge Re, so that the stagnated toner M is attracted to the trailing edge Re. In this manner, toner t in the toner stagnation M region moves in a downstream direction with movement of the image trailing edge Re while reciprocating in the gap SD.

Figure 27:
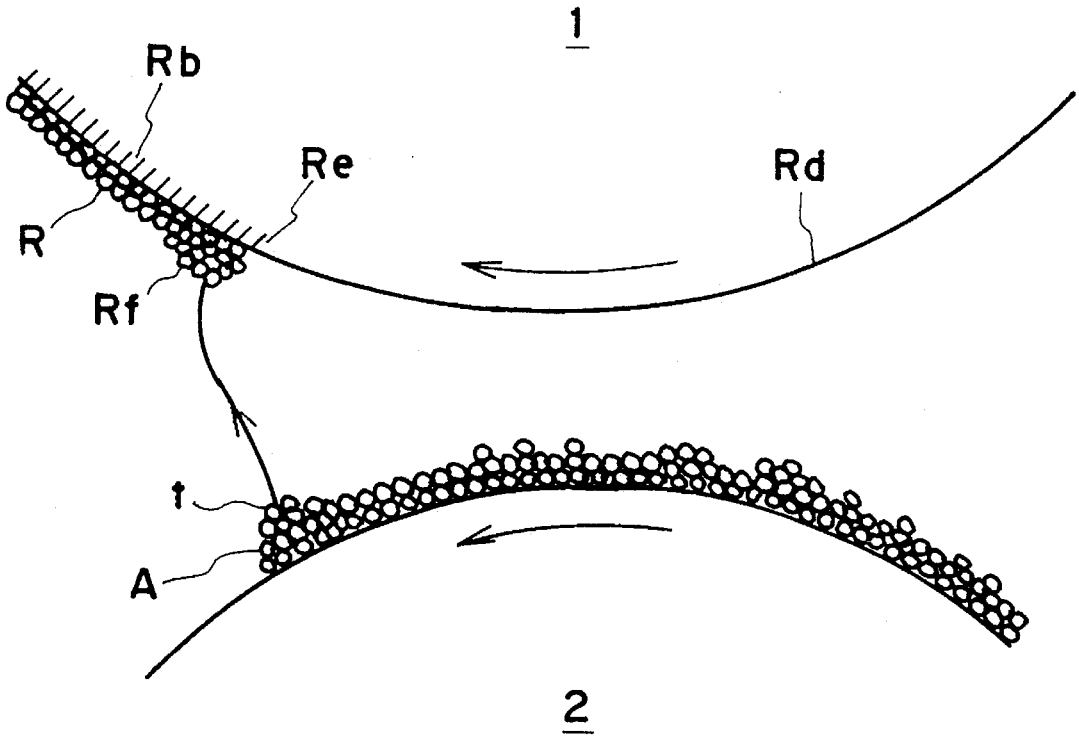
FIG. 27 is a sectional view illustrating a part of the mechanism.

Finally, as shown in FIG. 27, toner stagnation. M coming to the downstream portion with the reciprocation in the SD gap, together with the trailing edge of the image portion Re, is deposited at the trailing edge of the image portion Rb where the SD gap is large. In this manner, a downstream concentration Rf is formed at the trailing edge of the toner image R formed on the photosensitive drum 1.

From the foregoing analysis, in order to avoid downstream concentration, toner reciprocation is suppressed at the end portion where the electric lines of force are not straight.

In order to obtain sufficient image density in the non-contact developing method, sufficient toner reciprocation is desired in the central portion of the SD gap range, as is known.

Generally, the toner receives force Ft due to the electric field of the developing bias voltage:

$$Ft \propto Qt \times Vs/dSD$$

where dSD is the clearance of the SD gap, Vs is a potential of the developing sleeve 2, and Qt is a charge amount of the toner.

Figure 28:
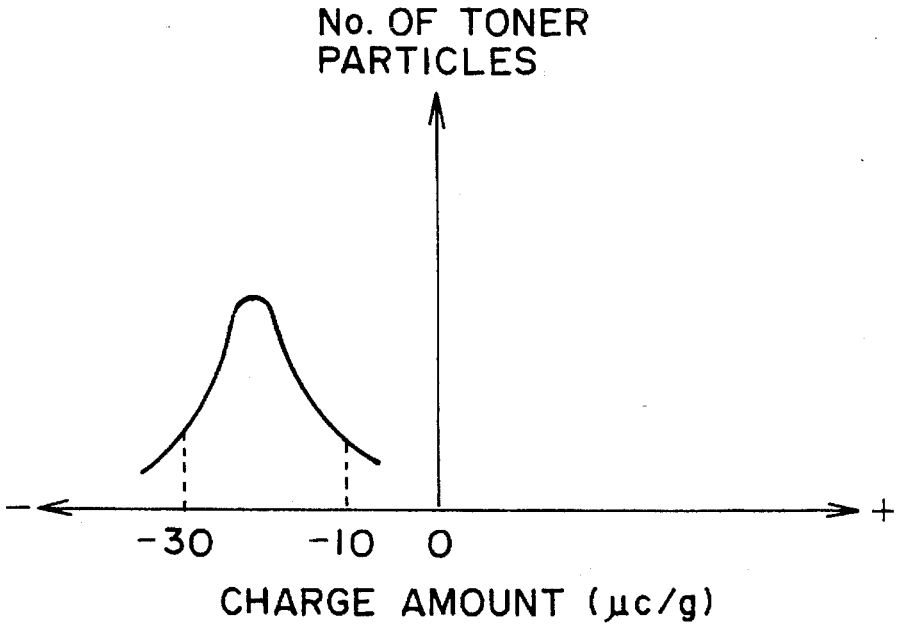
FIG. 28 is a graph of a distribution of a charge amount of the toner per unit mass on the developing sleeve.

The charge amount (triboelectric charge amount) per unit mass of the toner on the developing sleeve, as shown in FIG. 28, is not completely uniform but has some distribution, as is known. The force applied to the toner from the electric field and the mirror force received from the developing sleeve, is different for individual toner charge amount. With toner having a smaller amount of charge, the mirror force is small, and therefore, it can reciprocate in the SD gap even if the force provided by the electric field is small, but the speed is low because of low acceleration. On the contrary, with toner having a large charge amount, the mirror force is large, and therefore, the toner can not reciprocate in the SD gap unless the force from the electric field is large, but the speed is low because the acceleration is large.

Figure 29:
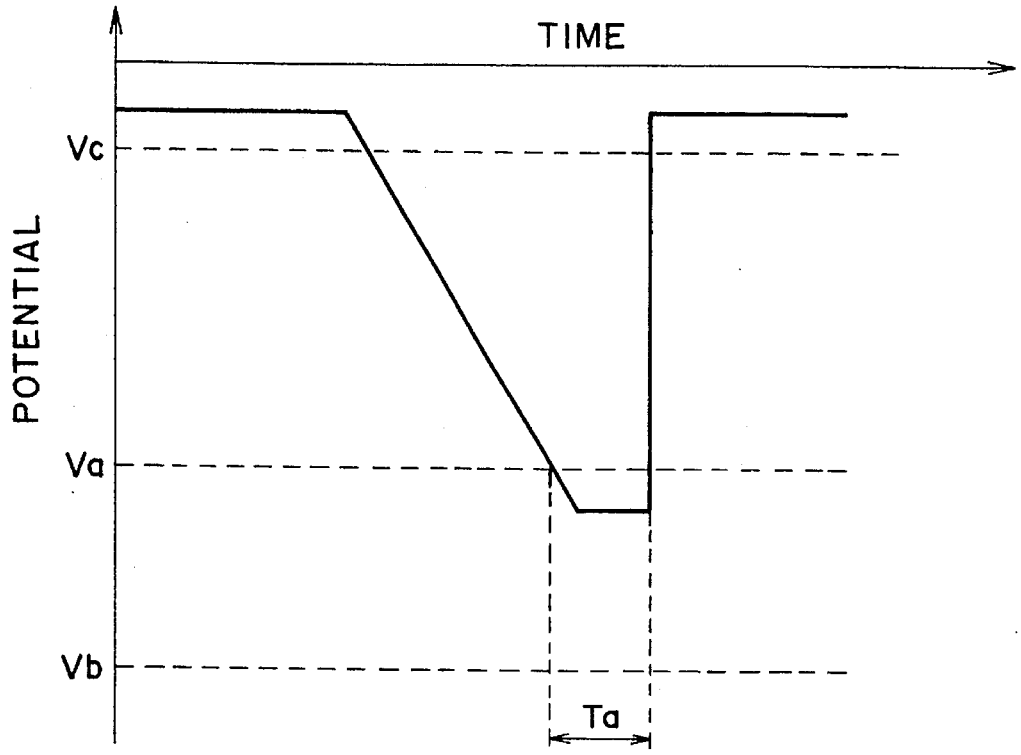
FIG. 29 shows a relationship between a potential at an end of the SD gap supplied with the falling regulated bias voltage and a movement period of the toner from the developing sleeve to the photosensitive drum.

FIG. 29 illustrates a relationship between a potential at an end of the SD gap wherein the developing sleeve Is supplied with the falling regulated bias voltage and the period required for the toner to move from the developing sleeve to the photosensitive drum. As shown in FIG. 23, when the developing sleeve is faced to the image portion of the surface of the photosensitive drum 1, the toner receives a force toward the photosensitive drum away from the developing sleeve under the falling regulated bias voltage in the end portion 14 where the SD gap is large. FIG. 29 shows the time period of this movement.

In FIG. 29, when the potential of the developing sleeve becomes Va, the force from the electric field provided by the developing bias voltage across the SD gap to the toner (ta) having a smaller charge amount, exceeds the mirror force received from the developing sleeve, so that the toner ta starts to move toward the photosensitive drum from the developing sleeve, but the potential of the developing sleeve immediately reaches the same potential as the image portion potential Vc, and the moving period Ta of the toner ta in this period is short.

On the other hand, in order that the force received from the electric field provided by the developing bias by the toner (tb) having a large charge amount exceeds the mirror force provided by the developing sleeve, the potential of the developing sleeve is required to be larger in the negative direction (Vb). Therefore, the toner tb is unable to separate from the developing sleeve.

Thus, for all of the toner particles irrespective of the toner charge amount, the reciprocation can be suppressed in the end portion where the SD gap is large, and therefore, the downstream edge concentration of the toner can be avoided.

Figure 30:
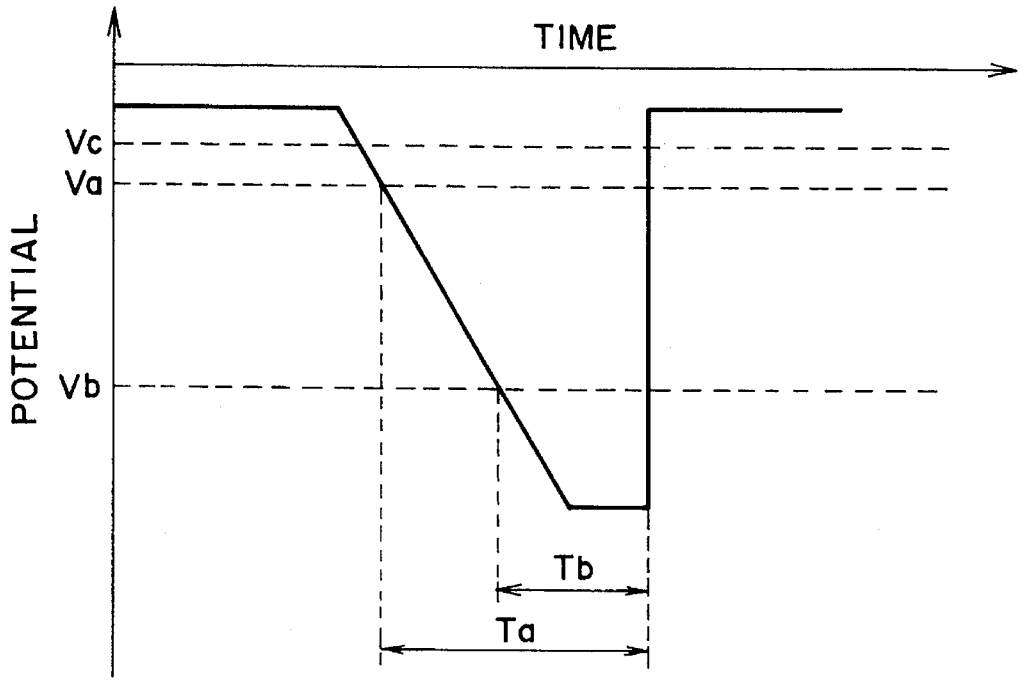
FIG. 30 shows a relationship between a potential at the central portion of the SD gap supplied with the falling regulated bias voltage and a movement period of the toner from the developing sleeve to the photosensitive drum.

FIG. 30 shows a relationship between a potential in the central portion where the SD gap is small wherein the developing sleeve is supplied with the falling regulated bias voltage and the movement period of the toner from the developing sleeve to the photosensitive drum.

In FIG. 30, when the potential of the developing sleeve 2 becomes Va, the force applied to the toner ta having a small amount of charge from the electric field provided by the developing bias across the SD gap exceeds the mirror force received from the developing sleeve 2, so that the toner ta starts to move from the developing sleeve toward the photosensitive drum 1. In this case, since the time period from the start of the movement of the toner ta from the developing sleeve 2 to the photosensitive drum to arrival of the developing sleeve 2 potential at Vc, is relatively long, the movement period Ta of the toner ta is longer, and therefore, the toner particles can sufficiently reciprocate in the SD gap.

As To the toner tb having the large charge amount, it starts to move toward the photosensitive drum when the potential of the developing sleeve 2 reaches vb.

The movement period Tb of the toner tb is shorter than for ta, but the acceleration of the toner tb is larger than that of the toner ta, and the speed is high, and therefore, sufficient reciprocation is possible within the short period of time.

As described above, with the use of the falling regulated bias voltage, the reciprocation of toner having different charge Mounts in the SD gap can be controlled by the falling period of the AC component of the developing bias voltage, so that toner reciprocation is suppressed in the end portions having the larger SD gap, irrespective of the charge amount of the individual toner particles, whereas toner reciprocation is sufficient in the central portion of the SD gap where the gap is small. Thus, the occurrences of the downstream concentration and the density insufficiency can be prevented, by controlling the inclination percentage $(\Delta T/T)\times 100$ which is the percentage of the developing bias $\Delta T$ relative to one period T of the developing bias voltage, so as to satisfy the following:

$$5.0 \leqq (\Delta T/T)\times 100 \leqq 40.0$$

Figure 31:
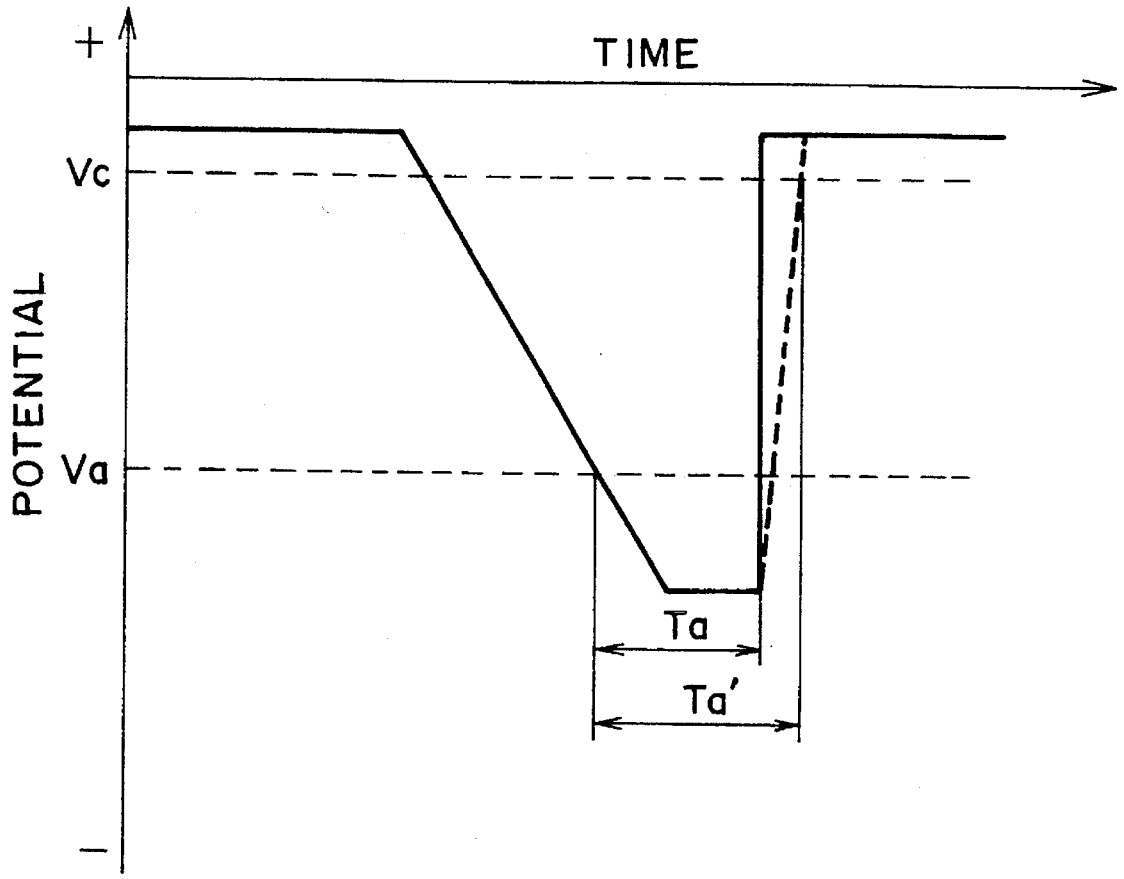
FIG. 31 shows a waveform of a developing bias voltage having a long rising period.

If the rising period of the developing bias is long as indicated by a broken line in FIG. 31, the movement period of the small charge amount toner ta changes from Ta to Ta with the result of a longer movement period, and therefore, the toner reciprocates at the end portion so that downstream concentration occurs. Therefore, a shorter rising period as in a rectangular pulse, is desirable.

An embodiment of this invention will be described.

Embodiment 1

Figure 1:
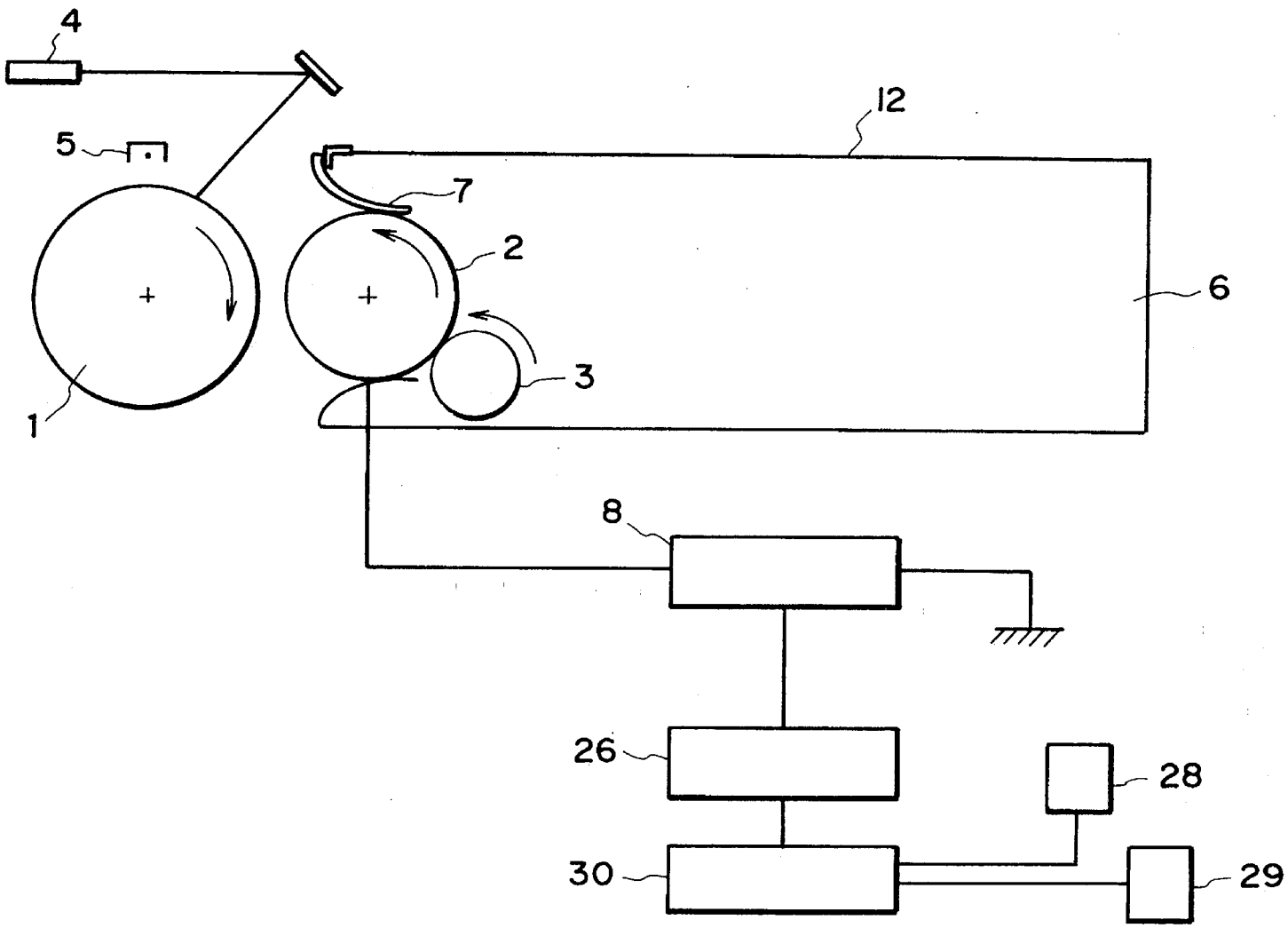
FIG. 1 is a sectional view of a developing apparatus according to an embodiment of the present invention.
Figure 2:
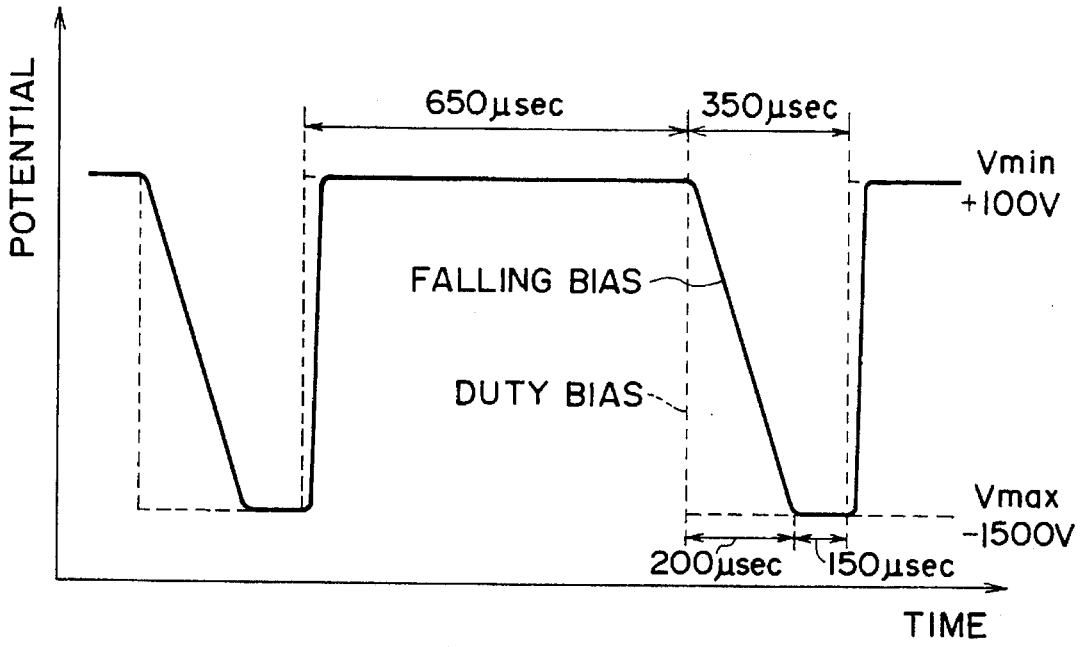
FIG. 2 illustrates a waveform of a developing bias voltage used under normal temperature and normal humidity condition according to a first embodiment of the present invention.

A conventional developing apparatus is modified. The SD gap was 300 μm, and the toner used was black toner for CLC 200 available from Canon Hanbai Kabushiki Kaisha, Japan. The developing bias voltage had a frequency of 1000 Hz, Vdc of −200 V, Vmax of −1500 V, Vmin of +100 V, and the falling of the pulse is regulated so that the duty percentage is 35% and the inclination percentage is 20%, as shown in FIG. 2. In FIG. 2, the duty bias is also shown to clarify the difference from a conventional duty bias (shown in phantom).

In this embodiment, the toner is a non-magnetic toner, but the present invention is applicable with the magnetic toner or two-component developer with the same advantageous effects. The toner may be positively chargeable. In this case, the developing bias is reversed in the polarities. In this embodiment, the development is a reverse development, but the regular development is also usable with the same advantageous effects.

In this embodiment, the above-described developing bias voltage waveform is used, and in addition a temperature and humidity detecting means is used to permit correction of the image change due to the variation of the temperature and/or the humidity An electrophotographic image forming apparatus subject to temperature and humidity changes due to the weather, depending on the individual regions on the earth. Under the normal temperature and humidity (N/N) condition (B) in FIG. 3, the triboelectric charge amount of the toner on the developing sleeve is substantially within the negative side, as shown in FIG. 4(*b*). However, under high temperature and high humidity (H/H) condition indicated by A in FIG. 3, the distribution of the triboelectric charge shifts totally toward the positive side, and the width increases. As a result, the mirror force relative to the sleeve decreases with the result of easy scattering of the toner and therefore an increase in the image density. However, because of the expanding of the triboelectric charge distribution, the downstream concentration is enhanced. Under a low temperature and low humidity condition indicated by C in FIG. 3, the distribution of the triboelectric charge totally shifts in one direction and the width decreases, as shown in FIG. 4(*c*). Therefore, the mirror force increases resulting in the difficulty of toner scattering and therefore the lower image density, but downstream concentration decreases because of the narrow triboelectricity distribution.

Therefore, in this embodiment, the inclination percentage is controlled to control the image density and the downstream concentration due to the temperature and humidity change, as shown in Table 1 below. A temperature sensor 28 in the form a usual thermocouple and temperature and humidity sensor controller 30 and humidity sensor 29 (EYHH02N, available from Matsushita Denki Sangyo Kabushiki Kaisha) also are used.

TABLE 1

| | H/H | N/N | L/L |
|---|---|---|---|
| Inclination % | 30% | 20% | 10% |
| Duty % | 35% | 35% | 35% |
| Vmax | −1500 V | −1500 V | −1500 V |

Figure 3:
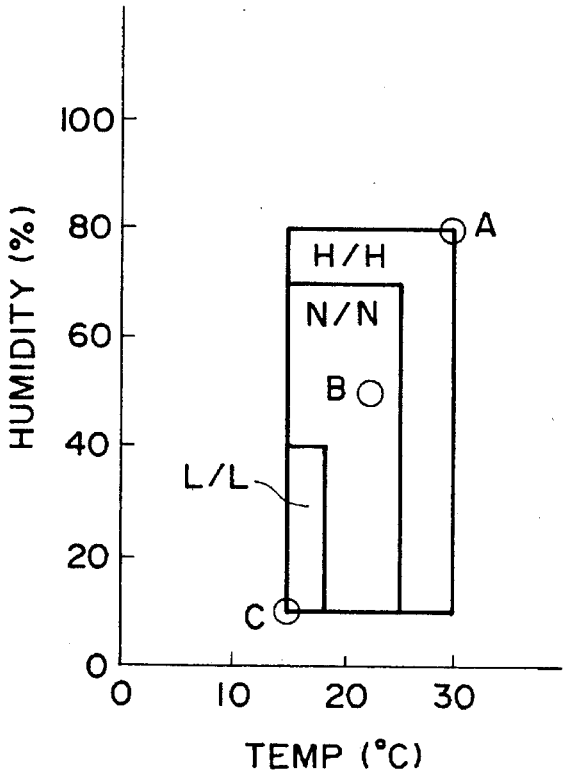
FIG. 3 illustrates areas depending on the ambient conditions of the developing apparatus of FIG. 1.
Figure 4A:
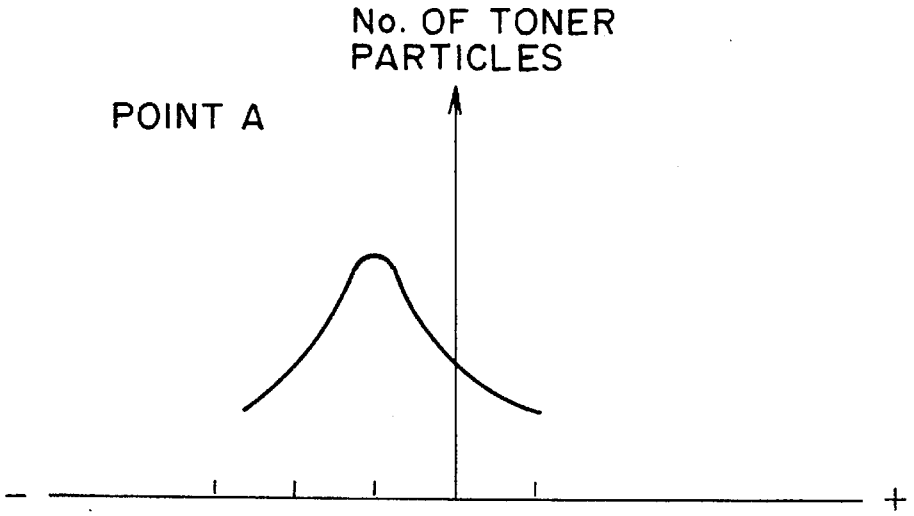
FIGS 4(*a*) to 4(*c*) are graphs showing the triboelectric charge amount of negatively charged toner on the developing sleeve under the respective areas in FIG. 3.
Figure 4B:
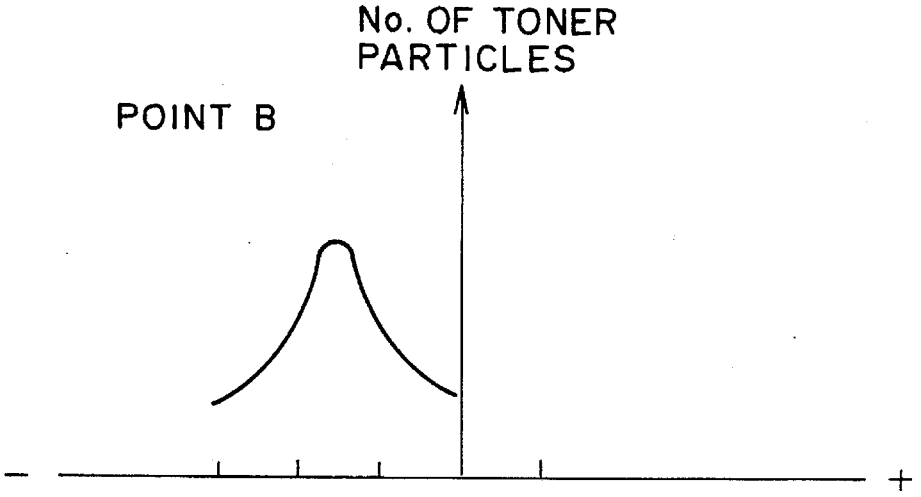
Figure 4C:
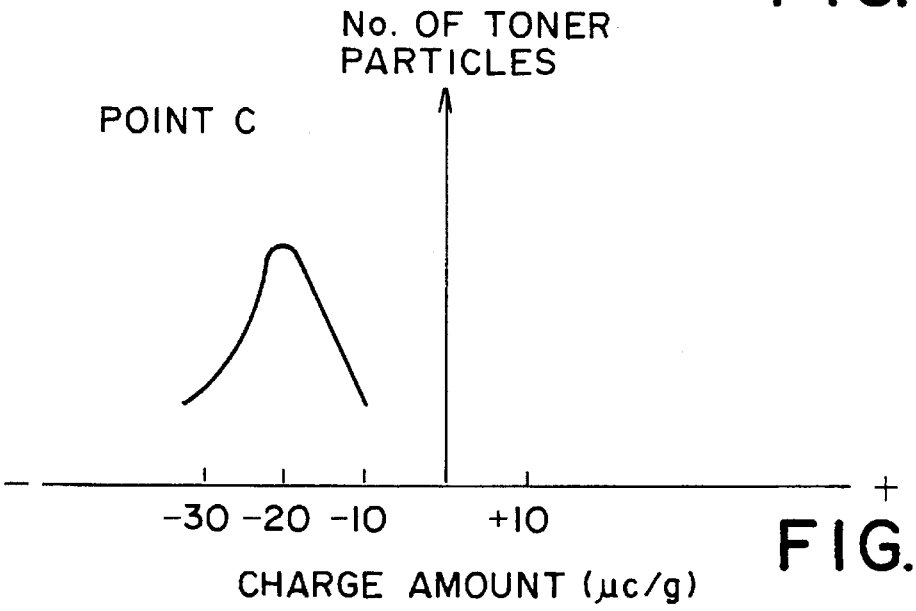
Figure 5:
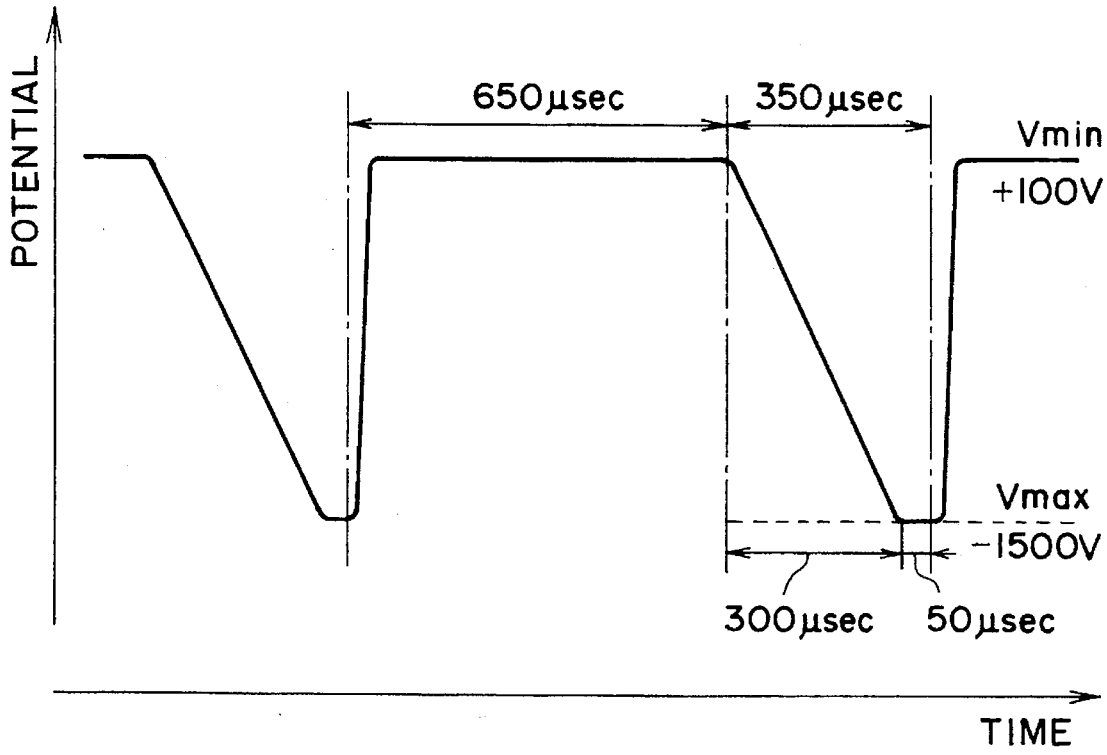
FIG. 5 shows a waveform of a developing bias voltage used under a high temperature and high humidity ambience in the apparatus of Embodiment 1.

As shown in Table 1, under high temperature and high humidity (H/H) conditions indicated by A in FIG. 3, downstream edge concentration of the toner increased by a larger triboelectricity distribution is suppressed by increasing the inclination percentage, and the time period of Vmax is reduced to suppress the image density increased by easier toner scattering tendency. The waveform under the H/H condition is shown in FIG. 5.

Figure 6:
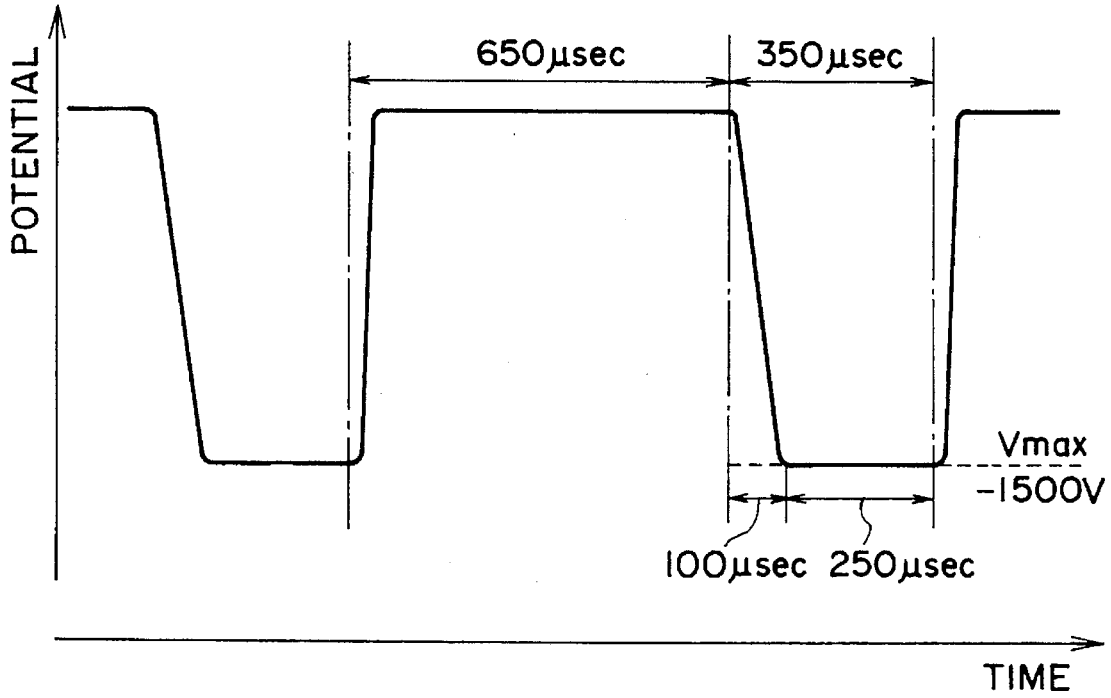
FIG. 6 shows a waveform of a developing bias voltage used under the low temperature and low humidity condition in the embodiment of FIG. 1.

When the temperature and humidity decrease toward N/N and L/L, downstream concentration decreases, but image density also decreases. Therefore, the inclination percentage is decreased as shown in Table 1, and the percentage of time period Vmax for accelerating the developing, is increased to effect the desired correction. FIG. 2 shows the developing bias voltage waveform under the N/N condition, and that under the L/L condition is shown in FIG. 6.

With this above-described structure, the apparatus can be operated with the best image quality condition in the respective temperature and humidity range, with the stabilization without the variation of the image quality due to the temperature or humidity change. In the foregoing embodiment, the temperature or humidity charge is compensated for by using a plurality of ranges, but image correction can be effected more finely, using image density detecting means in combination therewith.

Embodiment 2

In this embodiment, the period T of the developing bias voltage which has been fixed in Embodiment 1 is made variable. By changing the period, the change in the image quality due to a temperature or humidity change can be corrected.

TABLE 2

| | H/H | N/N | L/L |
|---|---|---|---|
| Inclination % | 24% | 20% | 10% |
| Period | 805 μsec | 1000 μsec | 1200 μsec |
| Vmax | −1500 V | −1500 V | −1500 V |

Figure 7:
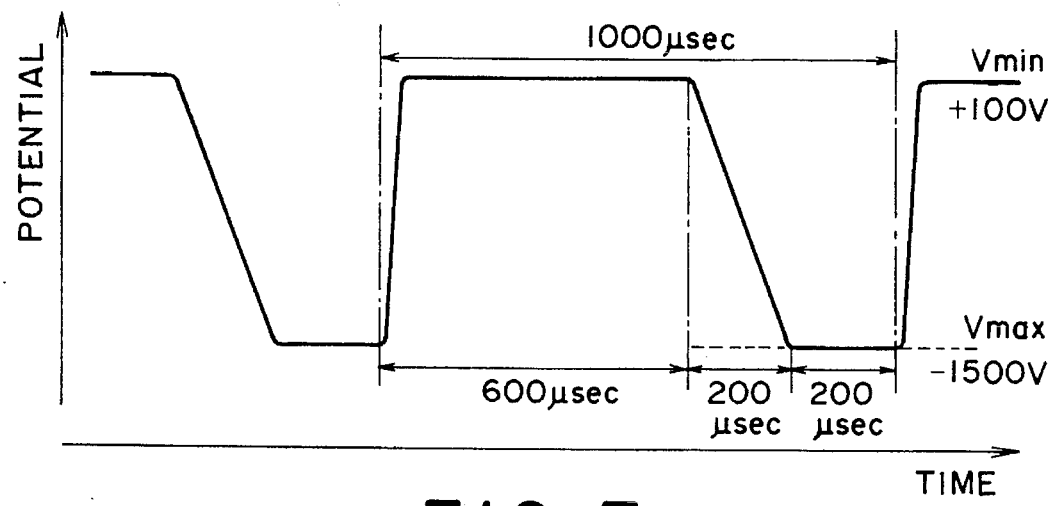
FIG. 7 shows a waveform of a developing bias voltage used under a normal temperature and normal humidity condition in Embodiment 2.
Figure 8:
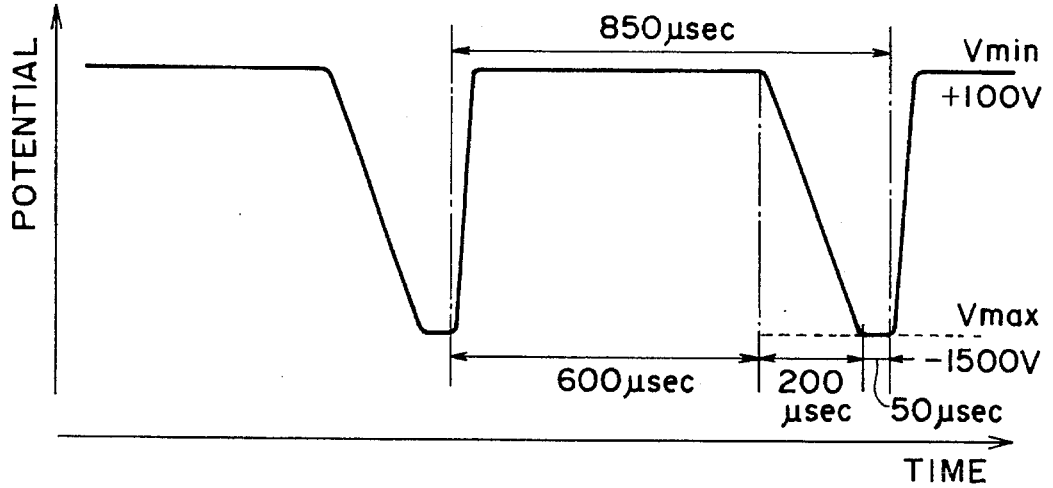
FIG. 8 shows a waveform of a developing bias voltage used under a high temperature and high humidity condition in Embodiment 2.
Figure 9:
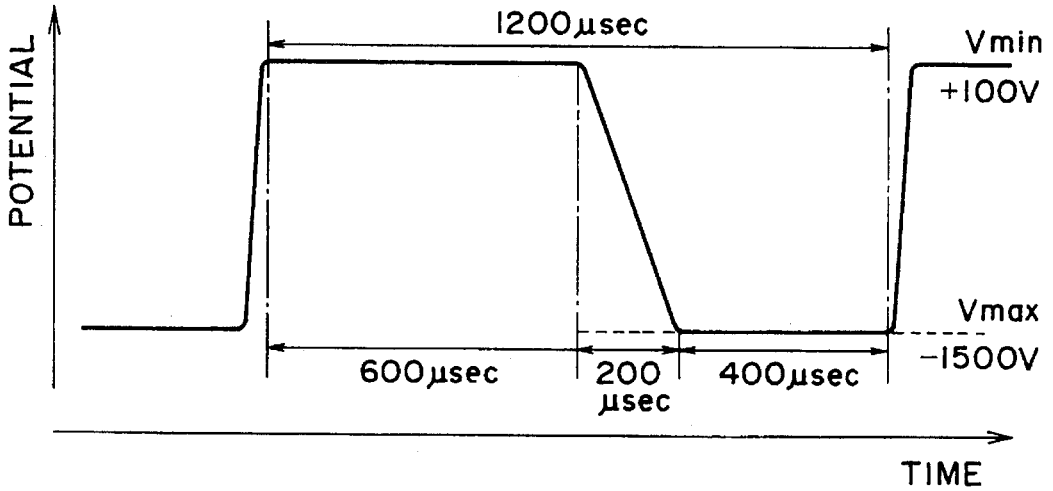
FIG. 9 shows a waveform of a developing bias voltage used under a low temperature and low humidity condition in Embodiment 2.

As shown in Table 2, under a high temperature and high humidity condition (H/H) indicated by A in FIG. 3, in order to suppress the downstream concentration resulting from a wider triboelectricity distribution, the time period of Vmax is reduced, and the time period is shortened, so that the inclination percentage is increased. FIG. 8 shows the waveform under H/H condition. With a reduction the temperature and humidity toward N/N and toward L/L, the downstream concentration decreases, but the image density also decreases. Therefore, the time period of Vmax is increased as shown in Table 2, by which the period T is made longer, thus reducing the ratio of the falling period ΔT relative to the period. In addition, the inclination percentage is reduced to increase the ratio of the Vmax period for accelerating development. FIG. 7 shows the developing bias voltage waveform for the N/N condition, and FIG. 9 shows that for the L/L condition.

With the above structure, the apparatus can be operated under a better image quality condition for respective temperature and humidity ranges with the stability without change of image quality due to temperature or humidity changes. According to this embodiment, the falling inclination can be kept constant, and therefore the embodiment is particularly advantageous when cost and complication are increased by making the inclination changeable, as when the falling inclination of the developing bias is provided by a circuit having a certain time constant.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a toner carrying member, disposable opposite an image bearing member for bearing an electrostatic image, for carrying toner to the image bearing member;

electric field forming means for forming an alternating electric field between said image bearing member and said toner carrying member, wherein the alternating electric field includes a first phase in which a constant electric field for urging toner from said image bearing member toward said toner carrying member continues for a predetermined period, a second phase in which a constant electric field for urging toner from said toner carrying member toward said image bearing member continues for a predetermined period, and a third phase in which the electric field gradually changes from the first phase to the second phase within a predetermined period ΔT>0; and means for changing a ratio of ΔT/T, where T is one period of the alternating electric field.

2. An apparatus according to claim 1, wherein said changing means changes the ratio ΔT/T in accordance with ambient temperature.

3. An apparatus according to claim 1, wherein said changing means changes the ratio ΔT/T in accordance with ambient humidity.

4. An apparatus according to claim 1, wherein the alternating electric field changes to a pulsewise shape in the change from the second phase to the third phase.

5. An apparatus according to claim 1, wherein said changing means changes the ratio ΔT/T in the following range:

$$5.0 \leqq (\Delta/T) \times 100 \leqq 40.0.$$

6. An apparatus according to claim 1, wherein the toner is a non-magnetic one component toner.

* * * * *

UNITED STATES PATENT AND TRADEMARK OFFICE

CERTIFICATE OF CORRECTION

PATENT NO. : 5,548,381

DATED : August 20, 1996

INVENTOR(S) : YOSHIRO SAITO, ET AL.

It is certified that error appears in the above-indentified patent and that said Letters Patent is hereby corrected as shown below:

COLUMN 5:

Line 17, "gap" should read --gap is--;
Line 23, "is" (second occurrence) should read --is,--; and,
Line 42, "the" should be deleted.

COLUMN 7:

Line 10, "Is" should read --is--;
Line 58, "To" should read --to--;
Line 60, "vb." should read --Vb.--; and,
Line 67, "Mounts" should read --amounts--.

COLUMN 8:

Line 6, "the" (second occurrence) should be deleted;
Line 16, "Ta" (second occurrence) should read --Ta'--;
Line 37, "the" (second occurrence) should be deleted;

Signed and Sealed this

Sixteenth Day of September, 1997

*Attest:*

Bruce Lehman

BRUCE LEHMAN

*Attesting Officer*

*Commissioner of Patents and Trademarks*